United States Patent [19]

Reinert

[11] Patent Number: 4,874,391

[45] Date of Patent: Oct. 17, 1989

[54] PROCESS FOR PHOTOCHEMICAL STABILIZATION OF POLYAMIDE FIBER MATERIAL AND MIXTURES THEREOF WITH OTHER FIBERS: WATER-SOLUBLE COPPER COMPLEX DYE AND LIGHT-STABILIZER

[75] Inventor: Gerhard Reinert, Allschwil, Switzerland

[73] Assignee: Ciba-Geigy Corporation, Ardsley, N.Y.

[21] Appl. No.: 75,805

[22] Filed: Jul. 20, 1987

[30] Foreign Application Priority Data

Jul. 29, 1986 [CH] Switzerland ..... 3034/86

[51] Int. Cl.[4] ..... D06M 13/26; D06M 11/04; D06P 1/62; D06P 3/24

[52] U.S. Cl. ..... 8/442; 8/490; 8/531; 8/568; 8/573; 8/602; 8/607; 8/624; 8/638; 8/680; 8/681; 8/685; 8/924

[58] Field of Search ..... 8/490, 624, 685, 442, 8/490, 442, 568, 573

[56] References Cited

U.S. PATENT DOCUMENTS

| | | | |
|---|---|---|---|
| 2,468,725 | 5/1949 | Gresham et al. | 560/154 |
| 3,270,091 | 8/1966 | Spivack | 558/162 |
| 3,363,969 | 1/1968 | Brooks | 8/493 |
| 3,403,183 | 9/1968 | Dobratz et al. | 568/324 |
| 3,630,662 | 12/1971 | Brody | 8/613 |
| 3,640,928 | 2/1972 | Murayama et al. | 524/99 |
| 3,840,494 | 10/1974 | Murayama et al. | 524/102 |
| 3,844,713 | 10/1974 | Saunders et al. | 8/539 |
| 3,989,455 | 11/1976 | Lofquist et al. | 8/495 |
| 3,993,655 | 11/1976 | Rasberger et al. | 546/188 |
| 4,127,586 | 11/1978 | Rody et al. | 548/260 |
| 4,187,212 | 2/1980 | Zinke et al. | 524/101 |
| 4,383,835 | 5/1983 | Preuss et al. | 8/602 |
| 4,511,596 | 4/1985 | Berner | 427/44 |
| 4,544,372 | 10/1985 | Heise et al. | 8/602 |
| 4,557,730 | 12/1985 | Bennet et al. | 8/442 |
| 4,655,783 | 4/1987 | Reinert et al. | 8/115.66 |
| 4,655,785 | 4/1987 | Reinert et al. | 8/442 |
| 4,698,064 | 10/1987 | Evans et al. | 8/128 R |
| 4,704,133 | 11/1987 | Reinert et al. | 8/442 |
| 4,707,161 | 11/1987 | Thomas et al. | 8/442 |

FOREIGN PATENT DOCUMENTS

| | | |
|---|---|---|
| 56-096965 | 8/1981 | Japan . |
| 57-128283 | 8/1982 | Japan . |
| 86/03528 | 6/1986 | PCT Int'l Appl. . |
| 1103144 | 2/1968 | United Kingdom . |

OTHER PUBLICATIONS

Hanes, American Dyestuff Reporter, vol. 69, No. 3, pp. 19–20 (1980).
Kirk–Othmer, 23, pp. 615–627.
Strobel, A D R, 50, (1961), pp. 583–588.
Strobel, A D R, 51 (1962), pp. 99–104.
Kirk–Othmer (3rd), 3, pp. 132–135.
Nikka Chemical Industry Co., Chemical Abstracts, vol. 98 (1983), No. 18061d.
Anton, Textile Chemists and Colorists, vol. 14, No. 10 (1982), pp. 216–221.
Kanebo Ltd., Chemical Abstracts, vol. 95 ( ), No. 152109S.
Strobel, American Dyestuff Reporter, 51 (1962), pp. 99–104.

*Primary Examiner*—A. Lionel Clingman
*Attorney, Agent, or Firm*—Wenderoth, Lind & Ponack

[57] ABSTRACT

A process for the photochemical stabilization of polyamide fiber material or mixtures thereof with other fiber materials which comprises treating the fiber material with a mixture of (A) a water-soluble copper complex dye or a mixture of copper complex compounds, at least one component being a water-soluble copper complex dye, (B) a light stabilizer and if desired (C) an antioxidant, an agent for carrying out the process and the fiber material treated therewith are described.

23 Claims, No Drawings

PROCESS FOR PHOTOCHEMICAL STABILIZATION OF POLYAMIDE FIBER MATERIAL AND MIXTURES THEREOF WITH OTHER FIBERS: WATER-SOLUBLE COPPER COMPLEX DYE AND LIGHT-STABILIZER

The present invention relates to a process for the photochemical stabilization of polyamide fibre material and mixtures thereof with other fibres by treatment with organic copper complex dyes, light stabilizers and antioxidants.

The use of copper salts, for example copper sulfate, for improving the light fastness of dyeings on polyamide fibres with metal complex dyes is common knowledge; see the paper by L. B. Hanes in ADR 69 (1980), 3, pages 19 and 20. However, inorganic as well as organic copper salts frequently have the disadvantage of going onto the polyamide fibre only insufficiently and irregularly and therefore having to be used in high concentrations to obtain the desired effect. Normally, they can only be used as aftertreatment and in batchwise processes.

EP-A-51,188 recommends improving the light fastness of polyamide dyeings by treating the polyamide material before, during or after the dyeing with a mixture of copper complexes of bisazomethines and light stabilizers.

However, such light fastness improvers have an undesirable self-colour and a not fully adequate hydrolysis and acid stability, as is correctly stated in EP-A-113,856 of the same applicant.

EP-A-162,811 and Textilveredlung 20 (1985), No. 11, pages 346–357, disclose the use of non-colouring copper complex compounds with dyebath stability and fibre affinity for light and heat stabilizing dyeings on polyamide fibres. The improvements in fastness and other properties obtained thereby are at present sufficient to meet the requirements of, for example, the automotive industry.

It has now been found that a mixture of copper complex dyes, light stabilizers and antioxidants permits a further improvement in fastness and other properties, such as light fastness and breaking strength.

The present invention accordingly provides a process for the photochemical stabilization of polyamide fibre material or mixtures thereof with other fibre materials, which comprises treating the fibre material with a mixture of (A) a water-soluble copper complex dye or a mixture of copper complex compounds at which at least one component is a water-soluble copper complex dye, (B) a light stabilizer and if desired (C) an antioxidant.

Component (A) is preferably selected from:

(a) water-soluble copper complex dyes, in particular water-soluble copper complex azo dyes, or preferably (b) mixtures of water-soluble copper complex dyes with acid, and weakly acid dyes respectively for polyamide fibres, and (c) mixtures containing at least one water-soluble copper complex dye and at least one water-soluble copper complex compound without dye characteristics, the said copper complex compounds advantageously being used in such an amount that for every 1 g of polyamide fibre material there is available 2 to 4,000, in particular 5 to 800, preferably 10 to 200, μg of copper are present.

Particular preference is given to copper complexes containing water-solubilizing groups of azo dyes of the formula

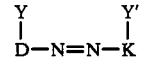

(1)

in which D is a radical of the benzene or naphthalene series, Y is an HO, $CH_3O$ or HOOC group and Y' is an HO or an amino group, and in which K is the radical of a coupling component of the benzene, naphthalene or heterocyclic series or the radical of a ketomethylene compound.

In the azomethine dyes of the formula (1) Y and Y' are bonded to D and K respectively in the position adjacent to the —N=N— group.

In the copper complex dyes, the water-solubilizing groups are selected for example from sulfone, sulfonamide, N-monodialkylsulfonamide or N,N-dialkylsulfonamide groups, carboxyl groups or in particular sulfonic acid groups.

Suitable sulfone groups are alkyl sulfone and in particular $C_1$–$C_4$-alkyl sulfone groups.

A suitable N-mono-dialkylsulfonamide or N,N-dialkylsulfonamide group has in particular one or two $C_1$–$C_4$-alkyl radicals.

In particular, preference for use as component (A) in the process according to the invention is given to copper complex dyes having one or two water-solubilizing groups, in particular having a single water-solubilizing group.

In an interesting embodiment of the process according to the invention, component (A) is a copper complex dye of the formula

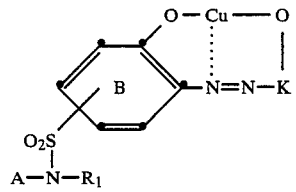

(2)

in which A is a substituted or unsubstituted carboxyphenyl or sulfophenyl radical, $R_1$ is hydrogen or $C_1$–$C_4$-alkyl, K is the radical of a coupling component of the benzene, naphthalene, pyrazolone, aminopyrazole, acetoacetanilide, 2,4-dioxyquinoline, pyridone or pyridine series, and the ring B can be further substituted, for example by chlorine or nitro.

The literature provides many examples of metallizable azo dyes of the formula (1). The azo dyes of the formula (1) are prepared in a manner known per se by diazotizing an amine of the formula

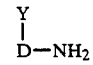

(3)

and coupling onto a coupling component of the formula $$\begin{array}{c} Y' \\ | \\ H-K \end{array} \quad (4)$$

The diazotiazation of the diazo component of the formula (3) is in general effected through the action of nitrous acid in aqueous/mineral acid solution at a low temperature, and the coupling onto the coupling component of the formula (4) at acid, neutral or alkaline pH.

Suitable amines of the formula (3) are for example: 2-amino-1-hydroxybenzene, 2-amino-1-methoxybenzene, anthranilic acid, 4- or 5-sulfonamidoanthranilic acid, 3- or 5-chloroanthranilic acid, 4-chloro- and 4,6-dichloro-2-amino-1-hydroxybenzene, 4- or 5- or 6-nitro-2-amino-1-hydroxybenzene, 4-chloro- and 4-methyl- and 4-acetylamino-6-nitro-2-amino-1-hydroxybenzene, 6-acetylamino- and 6-chloro-4-nitro-2-amino-1-hydroxybenzene, 4-cyano-2-amino-1-hydroxybenzene, 4-methoxy-2-amino-1-hydroxybenzene, 2-amino-1-hydroxyphenyl 5-methyl or 5-benzyl sulfone, 2-amino-1-hydroxybenzene 4-methyl, -ethyl, -chloromethyl or -butyl sulfone, 6-chloro-, 5-nitro- or 6-nitro-2-amino-1-hydroxybenzene 4-methyl sulfone, 2-amino-1-hydroxybenzene-4- or 5-sulfamide, -sulf-N-methylamide or -sulf-N-$\beta$-hydroxyethylamide, 2-amino-1-methoxybenzene-4-sulfanilide, 4-methoxy-5-chloro-2-amino-1-hydroxyebenzene, 4-methyl-2-amino-1-hydroxybenzene, 4-chloro-5-nitro-2-amino-1-hydroxybenzene, 5-nitro-4-methyl-2-amino-1-hydroxybenzene, 5-nitro-4-methoxy-2-amino-1-hydroxybenzene, 3,4,6-trichloro-2-amino-1-hydroxybenzene, 6-acetylamino-4-chloro-2-amino-1-hydroxybenzene, 4,6-dinitro-2-amino-1-hydroxybenzene, 4-nitro-2-amino-1-hydroxybenzene-5- or -6-sulfonamide, 4- or 5-chloroanisidine, 4- or 5-nitroanisidine, 2-methoxy-5-methylaniline, 2,5-dimethoxyaniline, 2-anisidinyl 4- or 5-$\beta$-hydroxyethyl sulfone, 4-methyl-6-sulfo-2-amino-1-hydroxybenzene, 2-amino-4-sulfo-1-hydroxybenzene, 4-chloro-6-sulfo-2-amino-1-hydroxybenzene, 6-chloro-4-sulfo-2-amino-1-hydroxybenzene, 5-nitro-4-sulfo-2-amino-1-hydroxybenzene, 4-nitro-6-sulfo-2-amino-1-hydroxybenzene, 6-nitro-4-sulfo-2-amino-1-hydroxybenzene, 4-acetylamino-2-amino-1-hydroxybenzene, 4-actylamino-6-sulfo-2-amino-1-hydroxybenzene, 5-acetylamino-2-amino-1-hydroxybenzene, 6-acetylamino-4-sulfo-2-amino-1-hydroxybenzene, 4-chloro-2-amino-4-hydroxybenzene-5-sulfamide, 2-amino-1-hydroxybenzene-4-(N-2'-carboxyphenyl)-sulfamide, 1-amino-2-hydroxy-4-sulfonaphthalene, 1-amino-2-hydroxy-4-sulfo-6-nitronaphthalene, 1-amino-2-hydroxy-4-sulfo-6-acetamidonaphthalene, 1-amino-2-hydroxy-4,8-disulfonaphthalene, 1-amino-2-hydroxy-6-sulfonaphthalene, 1-amino-2-hydroxy-7-sulfonaphthalene, 1-amino-2-hydroxy-8-sulfonaphthalene, 2-amino-1-hydroxy-4-sulfonaphthalene, 2-amino-1-hydroxy-6-sulfonaphthalene.

The coupling components of the formula (4) can be derived for example from the following groups of coupling components: P naphthols which couple in the o-position relative to the OH group and can be substituted by chlorine, amino, acylamino, acyl, $C_1$–$C_4$-alkyl, $C_1$–$C_4$-alkoxy, sulfonamido, N-monosubstituted or N,N-disubstituted sulfonamido groups, or sulfo or sulfone groups;

naphthylamines which couple in the o-position relative to the amino group and which can be substituted by halogen, in particular bromine, $C_1$–$C_4$-alkyl, $C_1$–$C_4$-alkoxy, sulfonamido, monosubstituted or disubstituted sulfonamido groups or sulfo or sulfone groups;

5-pyrazolones or 5-aminopyrazoles which have in the 1-position a phenyl or naphthyl radical which can be substituted by chlorine, nitro, $C_1$–$C_4$-alkyl or -alkoxy groups, sulfonamido or N-alkylated sulfonamide groups, sulfo groups, sulfone groups or in particular amino groups;

2,6-dihydro-3-cyano- or -3-carboxamido-4-alkylpyridines and 6-hydroxy-2-pyridones which are substituted in the 1-position by substituted or unsubstituted $C_1$–$C_4$-alkyl, for example methyl, isopropyl, $\beta$-hydroxyethyl, $\beta$-aminoethyl or $\gamma$-isopropoxypropyl, or by —$NH_2$ or a substituted amino group, for example dimethylamino or diethylamino, and carry in the 3-position a cyano or carboxamido group and in the 4-position a $C_1$–$C_4$-alkyl group, in particular methyl;

acetoacetanilides and benzoylacetanilides which can be substituted in the anilide nucleus by $C_1$–$C_4$-alkyl, -alkoxy, -alkylsulfonyl groups, $C_1$–$C_4$-hydroxyalkyl, alkoxyalkyl or cyanoalkylsulfonyl groups, sulfonamide, N-alkylated sulfonamido groups, sulfo, acetylamino or halogen;

phenols which are substituted by low molecular weight acrylamino groups and/or by alkyl groups containing 1 to 5 carbon atoms and couple in the o-position.

Examples of such coupling components are: 2-naphthol, 1-naphthol, 1-hydroxynaphthalene-4- or -5-sulfonic acid, 1,3- or 1,5-dihydroxynaphthalene, 1-hydroxy-7-aminonaphthalene-3-sulfonic acid, 2-naphthol-6-sulfonamide, 1-hydroxy-7-N-methylaminonaphthalene- or -N-acetylaminonaphthalene-3-sulfonic acid, 2-naphthol 6-$\beta$-hydroxyethyl sulfone, 1-hydroxy-6-aminonaphthalene- or -6-N-methylaminonaphthalene- or -6-N-acetylaminonaphthalene-3-sulfonic acid, 1-hydroxy-7-aminonaphthalene-3,6-disulfonic acid, 1-hydroxy-6-aminonaphthalene-3,5-disulfonic acid, 1-acetylamino-7-naphthol, 1-hydroxy-6-N-(4'-aminophenyl)aminonaphthalene-3-sulfonic acid, 1-hydroxy-5-aminonaphthalene-3-sulfonic acid, 1-propionylamino-7-naphthol, 2-hydroxy-6-aminonaphthalene-4-sulfonic acid, 1-carbomethoxyamino-7-naphthol, 1-hydroxy-8-aminonaphthalene-5-sulfonic acid, 1-carboethoxyamino-7-naphthol, 1-hydroxy-8-aminonaphthalene-5,7-disulfonic acid, 1-carbopropoxyamino-7-naphthol, 1-hydroxy-8-aminonaphthalene-3-sulfonic acid, 1-dimethylaminosulfonylamino-7-naphthol, 6-acetylamino-2-naphthol, 1-hydroxy-8-aminonaphthalene-3,5- or 3,6-disulfonic acid, 4-acetylamino-2-naphthol, 2-hydroxy-5-aminonaphthalene-4,7-disulfonic acid, 4-methoxy-1-naphthol, 4-acetylamino-1-naphthol, 1-naphthol-3-, -4- or -5-sulfonamide, 2-naphthol-3-, -4-, -5-, -6-, -7- or -8-sulfonamide, 5,8-dichloro-1-naphthol, 5-chloro-1-naphthol, 2-naphthylamine, 2-naphthylamine-1-sulfonic acid, 2-aminonaphthalene-5-, -6- or -7-sulfonamide, 2-aminonaphthalene-6-N-methyl-, -ethyl, -isopropyl-, -$\beta$-oxyethyl or -$\gamma$-methoxypropyl-sulfonamide, 2-aminonaphthalene-6-sulfanilide, 2-aminonaphthalene-6-N-methylsulfonanilide, 1-aminonaphthalene-3-, -4- or -5-sulfonamide, 1-aminonaphthyl 5-methyl or -ethyl sulfone, 5,8-dichloro-1-aminonaphthalene, 2-phenylaminonaphthalene, 2-N-metylaminonaphthalene, 2-N-ethylaminonaphthalene, 2-phenylaminonaphthalene-5-, -6- or -7-sulfonamide, 2-(3'-chlorophenylamino)-naphthalene-5-, -6- or -7-sulfonamide, 6-methyl-2-aminonaphthalene, 6-bromo-2-aminonaphthalene, 6-methoxy-2-aminonaphthalene, 1,3-dimethylpyrazolone, 3-methyl-5-pyrazolone, 1-phenyl-3-methyl- 5-pyrazolone, 1-phenyl-3-carboxamido-5-pyrazolone, 1-(2'-, 3'- or 4'-methylphenyl)-3-methyl-5-pyrazolone, 1-[3'- or 4'-(β-hydroxyethylsulfonyl)-phenyl]-3-methyl-5-pyrazolone, 1-(2'-methoxyphenyl)-3-methyl-5-pyrazolone, 1-(2'-, 3'- or 4'-chlorophenyl)-3-methyl-5-pyrazolone, 1-(2'-, 3'- or 4'-nitrophenyl)-3-methyl-5-pyrazolone, 1-(2',5'- or 3',4'-dichlorophenyl)-3-methyl-5-pyrazolone, 1-(2'-, 3'- or 4'-sulfamoylphenyl)-3-methyl-5-pyrazolone, 1-(2'-, 3'- or 4'-methylsulfonylphenyl)-3-methyl-5-pyrazolone, 2,6-dihydro-3-cyano-4-methylpyridine, 1-methyl-3-cyano-4-ethyl-6-hydroxypyrid-2-one, 1-amino-3-cyano-4-methyl-6-hydroxypyrid-2-one, 1-phenyl-3-carboxamido-4-methyl-6-hydroxypyrid-2-one, acetoacetanilide, acetoacet-o-, -m- or -p-sulfoanilide, acetoacet-4-(β-hydroxyethylsulfonyl)-anilide, acetoacet-o-anisidide, acetoacetnaphthylamide, acetoacet-o-toluidide, acetoacet-o-chloroanilide, acetoacet-m- or -p-chloroanilide, acetoacetanilide-3- or 4-sulfonamide, acetoacet-3- or -4-aminoanilide, acetoacet-m-xylidide, benzoylacetanilide, 4-methylphenol, 3-dialkylaminophenyl, in particular 3-dimethylamino- or 3-diethylamino-phenol, 4-t-butylphenol, 4-t-amylphenol, 2- or 3-acetylamino-4-methylphenol, 2-methoxycarbonylamino-4-methylphenol, 2-ethoxycarbonylamino-4-methylphenol, 3,4-dimethylphenol and 2,4-dimethylphenol, 1-(4'-aminophenyl)-3-methyl-5-pyrazolone, 1-(2'-, 3'- or 4'-sulfophenyl)-3-methyl-5-pyrazolone, 1-(2'-chloro-4'- or 5'-sulfophenyl)-3-methyl-5-pyrazolone, 1-(2'-methyl-6'-chlorophenyl)-3-methyl-5-pyrazolone, 1-(2'-methyl-4'-sulfophenyl)-3-methyl-5-pyrazolone, 1-(2'-, 3'- or 4'-chloro- or methyl- or sulfophenyl)-3-carboxy-5-pyrazolone, 1-(5'-sulfonaphth-2'-yl)-3-methyl-5-pyrazolone, 1-(4''-amino-2',2''-disulfostilb-4'-ene)-3-methyl-5-pyrazolone, 1-ethyl-3-cyano-4-methyl-6-hydroxypyrid-2-one, 1-ethyl-3-sulfomethyl-4-methyl-6-hydroxypyrid-2-one, 2,6-dihydroxy-3-cyano-4-sulfomethylpyridine, 2,4,6-trihydroxypyrimidine, 2,3-dihydroxypyridine, 5-bromo-(chloro)-2,3-dihydroxypyridine, 2-amino-3-hydroxypyridine, 5-bromo-2-amino-3-hydroxypyridine, 5-ethylmercapto-2,3-dihydroxypyridine, 5-phenylsulfonyl-2,3-dihydroxypyridine, 2,3-dihydroxypyridine-5-sulfonic acid and 2-amino-3-hydroxypyridine-5-sulfonic acid.

The metal complexes are prepared by methods known per se in an aqueous or organic medium. The copper-donating agents used are copper salts, for example copper sulfate or copper nitrate. It is also possible to use the freshly precipitated hydroxides. The reaction is carried out in the weakly acid or alkaline range. It is possible for example to use copper sulfate in an aqueous medium in the presence of sodium acetate or ammonia, or copper nitrate in the presence of sodium carbonate in an organic medium such as methyl "Cellosolve".

In general, the reaction is carried out by heating, for example at somewhat below the boiling point of the solvent used.

In a further embodiment of the process according to the invention, component (A) is a mixture containing at least one water-soluble copper complex dye and a water-soluble copper complex which has fibre affinity and is based on an organic compound which is not a dye, i.e. has no chromophoric groups.

The non-chromophoric component is preferably selected from sulfo-containing copper complexes of bisazomethines, acylhydrazones, semicarbazones and thiosemicarbazones of aromatic aldehydes or ketones. Compounds of this type are readily water-soluble and, in addition, have high affinity for polyamide fibre. Such complexes are therefore effective even in small amounts. In addition, it has been found that they do not only increase the light fastness of the dyed polyamide material but, very generally, protect the polyamide fibre from photochemical degradation and thus substantially preserve their mechanical properties, such as breaking strength and elasticity.

Bisazomethines of aromatic aldehydes and ketones refers herein to Schiff bases of aliphatic or cycloaliphatic diamines, the aldehydes and ketones having an OH group in the o-position relative to the formyl or acyl radical. The bond to the copper atom is effected via these two OH groups and the two nitrogen atoms in the bisazomethine part. The ligands in question here are accordingly tetradentate. They contain one or more sulfo groups, which are situated in the aldehyde or ketone part and/or in the bisazomethine bridge.

In preferred embodiments of the process according to the invention, component (A) is a mixture containing a copper complex dye and a copper complex without dye characteristics (a) of the formula

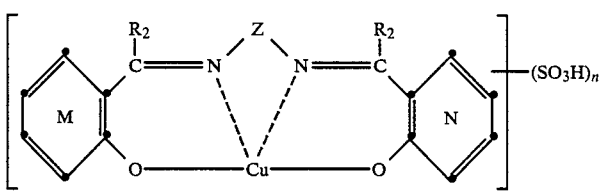

(5)

in which $R_2$ is hydrogen or a substituted or unsubstituted alkyl or aryl radical, Z is a substituted or unsubstituted alkylene or cycloalkylene radical, n is 1, 2 or 3 and the rings M and N can be substituted independently of each other; or (b) of the formula

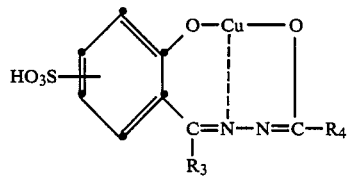

(6)

in which $R_3$ and $R_4$ are independently of each other defined in the same way as $R_2$; or (c) of the formula

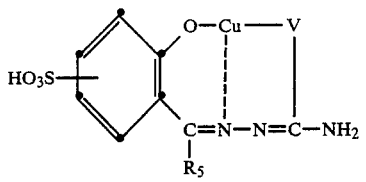

(7)

in which $R_5$ is hydrogen or a substituted or unsubstituted alkyl or aryl radical and V is an oxygen or sulfur atom.

A substituted or unsubstituted alkyl radical $R_2$, $R_3$ or $R_5$ is preferably a $C_1$–$C_8$-alkyl radical, in particular a $C_1$–$C_4$-alkyl radical, which can be branched or unbranched and/or substituted, namely by halogen, for example fluorine, chlorine or bromine, $C_1$–$C_4$-alkoxy, for example methoxy or ethoxy, by a phenyl or carbonyl radical, by $C_1$–$C_4$-alkylcarbonyl, for example an acetyl radical, or by hydroxy or a monoalkylated or dialkylated amino group. In addition, another possibility is the cyclohexyl radical which can likewise be substituted, for example by $C_1$–$C_4$-alkyl or $C_1$–$C_4$-alkoxy.

A substituted or unsubstituted aryl radical $R_2$, $R_3$ or $R_5$ can be in particular a phenyl or naphthyl radical which can be substituted by $C_1$–$C_4$-alkyl, such as methyl, ethyl, propyl, isopropyl, butyl, isobutyl, sec.-butyl or tert.-butyl, $C_1$–$C_4$-alkoxy, for example methoxy, ethoxy, propoxy, isopropoxy, butoxy, isobutoxy, sec.-butoxy or tert.-butoxy, halogen, for example fluorine, chlorine or bromine, $C_2$–$C_5$-alkanoylamino, for example acetylamino, propionylamino or butyrylamino, nitro, cyano, sulfo or a monoalkylated or dialkylated amino group.

An alkylene radical Z can be in particular a $C_2$–$C_4$-alkylene radical, in particular a —$CH_2$—$CH_2$-bridge. However, other possibilities are a $C_2$–$C_8$-alkylene chain which is interrupted by oxygen or in particular by nitrogen, especially the —$(CH_2)_3$—NH—$(CH_2)_3$— bridge.

A cycloalkylene radical Z is preferably cyclohexylene and can have one or two methyl groups.

Possible substituents for the benzene rings M and N are for example: $C_1$–$C_4$-alkyl, $C_1$–$C_4$-alkoxy, halogen, for example fluorine, chlorine or bromine, and also cyano or nitro.

The sulfo groups which are situated in the benzene rings M and/or N are preferably present in the form of an alkali metal salt, in particular a sodium salt, or, alternatively, as an amine salt.

In particular, the present process finds utility for copper complexes of the formula (5) in which $R_2$ is hydrogen, Z is an ethylene or cyclohexylene bridge and n is 2 and in which the two sulfo groups are situated in the benzene rings M and N, in particular those complexes where the sulfo groups are each arranged in the p-position relative to the oxygen. Therein Z is preferably —$CH_2$—$CH_2$—.

An alkylene radical $R_4$ can be branched or unbranched and has a chain length of preferably 1 to 8, in particular 1 to 4, C atoms. Possible substituents are halogen, such as fluorine, chlorine or bromine, $C_1$–$C_4$-alkoxy, such as methoxy or ethoxy, phenyl, carboxy, $C_1$–$C_4$-alkylcarbonyl, for example acetyl, hydroxy, monoalkylamino or dialkylamino.

A substituted or unsubstituted aryl radical $R_4$ can be in particular a phenyl or naphthyl radical which can be substituted by $C_1$–$C_4$-alkyl, for example methyl, ethyl, propyl, isopropyl, butyl, isobutyl, sec.-butyl or tert.-butyl, $C_1$–$C_4$-alkoxy, such as methoxy, ethoxy, propoxy, isopropoxy, butoxy, isobutoxy, sec.-butoxy or tert.-butoxy, halogen, for example fluorine, chlorine or bromine, $C_2$–$C_5$-alkanoylamino, such as acetylamino, propionylamino or butyrylamino, nitro, cyano, sulfo or a monoalkylated or dialkylated amino group.

Similarly, the complexes of the formula (6) are preferably used in a neutral form, i.e. as alkali salt, particular sodium salt or amine salt.

Preference is given to using those complexes of the formula (6) in which $R_3$ is hydrogen and $R_4$ is hydrogen, methyl or in particular phenyl, in particular to those complexes in which the sulfo group is again in the p-position relative to the oxygen.

In addition to the copper complexes of the formulae (6) and (7) whose ligands are derived from sulfosalicylaldehyde or the corresponding phenyl ketones, it is also possible to use for example those where, instead of mononuclear aromatic aldehydes and ketones, polynuclear aromatic aldehydes and ketones, for example 2-hydroxy-1-naphthaldehydesulfonic acid, are used for developing the ligand. In addition, it is noteworthy that the fourth coordination site of the metal atom in the complexes of the formulae (6) and (7) is occupied by water as a neutral ligand.

In the process according to the invention, the ratio of copper complex dye:water-soluble copper complex having fibre affinity and being based on an organic compound which itself has no dye characteristics is preferably 99:1 to 10:90.

The mixing ratio depends on the number of copper complex dyes used and on the desired depth of shade of the dyeings and is chosen in such a way that the copper content of the polyamide fibre material is above 5 ppm, preferably above 10 ppm.

The copper complexes of the stated formulae (5), (6) and (7) and alkali metal salts thereof, such as the potassium or lithium salts, and in particular sodium salts thereof, are obtained by known methods.

The metal complexes of the formula (5) are accessible for example in two different ways. For instance, the aldehyde or ketone can first be metallized and then be reacted with the appropriate diamine to give the completed complex of the formula (5). Alternatively, however, first the ligands can be synthesized from aldehyde or ketone and diamine and then the metallization be carried out.

The acylhydrazones, the ligands of complexes (6), are obtained for example by reaction of the aldehyde or ketone with the corresponding monoacylhydrazine and subsequent metallization. The complexes of the formula (7) can be prepared in a very similar way. At least one of the starting materials for preparing the compounds of the formula (5), (6) or (7) needs to contain a sulfonic acid group.

Preference is given to using as component (A) the copper complexes of the formulae (5) to (7), in particular the copper complexes of the formulae (5) and (6).

Very particular preference is given within the group of metal complexes having a bisazomethine ligand to copper complexes of the formulae (8)

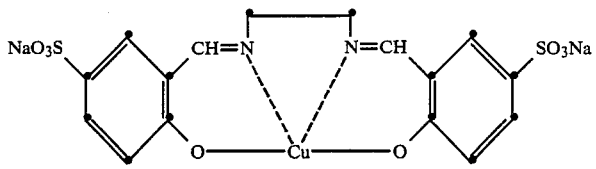

(9)

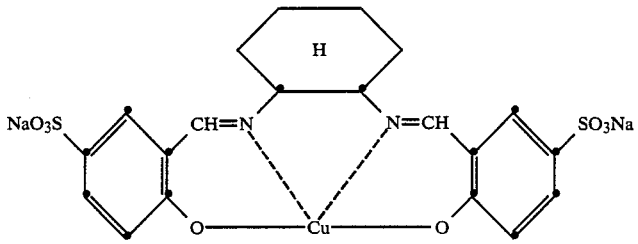

and within the group of metal complexes having an acylhydrazone ligand to copper complexes of the formulae (10)

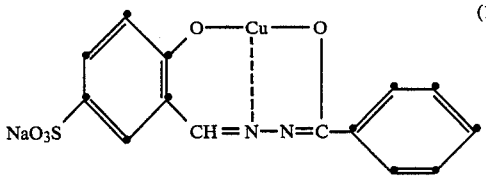

(11)

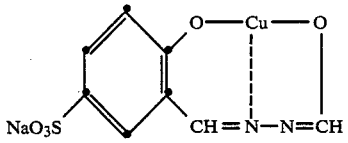

(12)

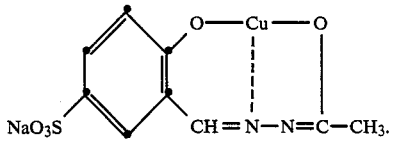

The fourth coordination site of the copper in the complexes of the formulae (10), (11) and (12) is occupied by water without this fact being expressly noted in the structural formulae.

In a further preferred embodiment of the process according to the invention, component (A) comprises using at least one copper complex dye together with acid dyes, in particular in the same dyebath.

Suitable acid dyes are for example metal-free monoazo or polyazo dyes, 1:2-chromium or 1:2-cobalt complex azo dyes, anthraquinone, dioxazine, phthalocyanine, nitroaryl or stilbene dyes which have at least one acid group, for example a carboxyl, sulfo, $C_1$–$C_4$-alkylsulfonyl, sulfamoyl or di-$C_1$–$C_4$-alkylsulfamoyl group, preferably a sulfo group.

An interesting embodiment of the process according to the invention comprises for example using for trichromatic dyeing a mixture of at least one red-dyeing dye, at least one yellow- or orange-dyeing dye and at least one blue-dyeing dye, the mixture containing at least one copper complex dye.

Component (B) can be any compound known also as a UV absorber and described for example in Kirk-Othmer 23, 615–627; A. F. Strobel, ADR, 50, (1961), 583–588; 51 (1962) 99–104; R. Gächter and H. Müller, Taschenbuch der Kunststoff-Additive [Handbook of plastics additives], Carl Hanser Verlag, Munich pages 101–198 (1983), and in US-A-4,511,596.

The copper complex dyes can if desired be used in combination with conventional dyes for polyamide fibre material.

Component (B) can be selected for example from the following compounds:

(a) 2-hydroxybenzophenones of the formula (13)

(13)

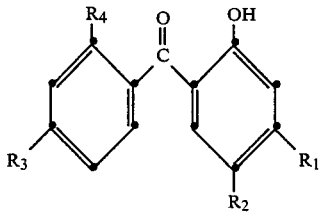

in which $R_1$ is hydrogen, hydroxy, $C_1$–$C_4$-alkoxy or phenoxy, $R_2$ is hydrogen, halogen, $C_1$–$C_4$-alkyl or sulfo, $R_3$ is hydrogen, hydroxy or $C_1$–$C_4$-alkoxy and $R_4$ is hydrogen, hydroxy or carboxy, for example the 4-hydroxy, 4-methoxy, 4-octyloxy, 4-decyloxy, 4-dodecyloxy, 4-methoxy-2′-carboxy, 4,2′,4′-trihydroxy, 4,4′-dimethoxy-2′-hydroxy, 4-methoxy-5-sulfo, 2′-hydroxy-4,4′-dimethoxy-5-sulfo, 4-benzyloxy or 5-chloro derivative;

(b) 2-(2′-hydroxyphenyl)-benzotriazoles of the formula (14)

(14)

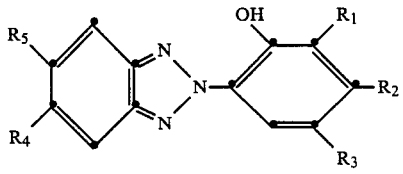

in which $R_1$ is hydrogen, $C_1$–$C_{12}$-alkyl, chlorine, $C_5$–$C_6$-cycloalkyl, $C_7$–$C_9$-phenylalkyl or sulfo, $R_2$ is hydrogen, $C_1$–$C_4$-alkyl, $C_1$–$C_4$-alkoxy, chlorine, hydroxy or sulfo, $R_3$ is $C_1$–$C_{12}$-alkyl, $C_1$–$C_4$-alkoxy, phenyl, ($C_1$–$C_8$-alkyl)-phenyl, $C_5$–$C_6$-cycloalkyl, $C_2$–$C_9$-alkoxycarbonyl, chlorine, carboxyethyl, $C_7$–$C_9$-phenylalkyl or sulfo, $R_4$ is hydrogen, chlorine, $C_1$–$C_4$-alkyl, $C_1$–$C_4$-alkoxy, $C_2$–$C_9$-alkoxycarbonyl, carboxy or sulfo and $R_5$ is hydrogen or chlorine, where the carboxy and sulfo radicals can also be present as salt, for example alkali metal, alkaline earth metal, ammonium or amine salts. Examples of compounds of the formula (14) are the 5'-methyl, 3',5'-di-tert.-butyl, 5'-tert.-butyl, 5'-(1,1,3,3-tetramethylbutyl), 5-chloro-3',5'-di-tert.-butyl, 5-chloro-3'-tert.-butyl-5'-methyl, 3'-sec.-butyl-5'-tert.-butyl, 4'-octyloxy, 3',5'-di-tert.-amyl and 3',5'-bis-(α,α-dimethylbenzyl) derivative and the sodium salt of 2-(2'-hydroxy-3'-tert.-butyl-5'-methylphenyl)-5-(2H)-benzotriazolesulfonic acid, of 3-tert.-butyl-4-hydroxy-5-[benzotriazol-2-yl]-benzenesulfonic acid, of 3-tert.-butyl-4-hydroxy-5-[5-chlorobenzotriazol-2-yl]-benzenesulfonic acid and of 3-sec.-butyl-4-hydroxy-5-[benzotriazol-2-yl]-benzenesulfonic acid; or (c) compounds from the class of the sterically hindered amines, for example a 2,2,6,6-tetraalkylpiperidine derivative which contains in its molecule at least one group of the formula (15)

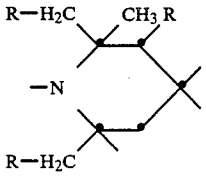

(15)

in which R is hydrogen or methyl.

The light stabilizers can contain one or more such groups of the formula (15), being for example a mono-, bis-, tris-, tetra- or oligo-piperidine compound. Preference is given to piperidine derivatives which contain one or more groups of the formula (15) in which R is hydrogen and to those whose ring nitrogen carries no hydrogen atom.

Most of these piperidine light stabilizers carry polar substituents in the 4-position of the piperidine ring.

Importance attaches in particular to the following classes of piperidine compounds.

(aa) Compounds of the formula (16)

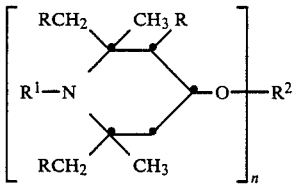

(16)

in which n is a number from 1 to 4, preferably 1 or 2, R is hydrogen or methyl, $R^1$ is hydrogen, oxyl, $C_1$–$C_{18}$-alkyl, $C_3$–$C_8$-alkenyl, $C_3$–$C_8$-alkynyl, $C_7$–$C_{12}$-aralkyl, $C_1$–$C_8$-alkanoyl, $C_3$–$C_5$-alkenoyl, glycidyl or a —$CH_2CH(OH)$—Z group in which Z is hydrogen, methyl or phenyl, $R^1$ preferably being $C_1$–$C_{12}$-alkyl, allyl, benzyl, acetyl or acryloyl, and $R^2$, when n is 1, being hydrogen, $C_1$–$C_{18}$-alkyl which can be interrupted by one or more oxygen atoms, or being cyanoethyl, benzyl, glycidyl, a monovalent radical of an aliphatic, cycloaliphatic, araliphatic, unsaturated or aromatic carboxylic acid, carbamic acid or phosphorus-containing acid or a monovalent silyl radical, preferably a radical of an aliphatic carboxylic acid having 2 to 18 C atoms, of a cycloaliphatic carboxylic acid having 7 to 15 C atoms, of an α,β-unsaturated carboxylic acid having 3 to 5 C atoms or of an aromatic carboxylic acid having 7 to 15 C atoms, or, when n is 2, being $C_1$–$C_{12}$-alkylene, $C_4$–$C_{12}$-alkenylene, xylylene, a divalent radical of an aliphatic, cycloaliphatic, araliphatic or aromatic dicarboxylic acid, dicarbamic acid or phosphorus-containing acid or a divalent silyl radical, preferably a radical of an aliphatic dicarboxylic acid having 2 to 36 C atoms, of a cycloaliphatic or aromatic dicarboxylic acid having 8–14 C atoms or of an aliphatic, cycloaliphatic or aromatic dicarbamic acid having 8–14 C atoms, or, when n is 3, being a trivalent radical of an aliphatic, cycloaliphatic or aromatic tricarboxylic acid, of an aromatic tricarbamic acid or of a phosphorus-containing acid or a trivalent silyl radical, or, when n is 4, being a tetravalent radical of an aliphatic, cycloaliphatic or aromatic tetracarboxylic acid.

Any $C_1$–$C_{12}$-alkyl substituents are for example methyl, ethyl, n-propyl, n-butyl, sec.-butyl, tert.-butyl, n-hexyl, n-octyl, 2-ethylhexyl, n-nonyl, n-decyl, n-undecyl or n-dodecyl.

A $C_1$–$C_{18}$-alkyl $R^1$ or $R^2$ can be for example one of the abovementioned groups and in addition, for example, n-tridecyl, n-tetradecyl, n-hexadecyl or n-octadecyl.

A $C_3$–$C_8$-alkenyl $R^1$ can be for example 1-propenyl, allyl, methallyl, 2-butenyl, 2-pentenyl, 2-hexenyl, 2-octenyl or 4-tert.-butyl-2-butenyl.

A $C_3$–$C_8$-alkynyl $R^1$ is preferably propargyl.

A $C_7$–$C_{12}$-aralkyl $R^1$ is in particular phenethyl or especially benzyl.

A $C_1$–$C_8$-alkanoyl $R^1$ is for example formyl, propionyl, butyryl, octanoyl, but preferably acetyl, and a $C_3$–$C_5$-alkenoyl $R^1$ is in particular acryloyl.

A monovalent radical $R^2$ of a carboxylic acid is for example an acetic acid, caproic acid, stearic acid, acrylic acid, methacrylic acid, benzoic acid or β-(3,5-di-tert.-butyl-4-hydroxyphenyl)-propionic acid radical.

A divalent radical $R^2$ of a dicarboxylic acid is for example a malonic acid, adipic acid, suberic acid, sebacic acid, maleic acid, phthalic acid, dibutylmalonic acid, dibenzylmalonic acid, butyl-(3,5-di-tert.-butyl-4-hydroxybenzyl)-malonic acid or bicycloheptenedicarboxylic acid radical.

A trivalent radical $R^2$ of a tricarboxylic acid is for example a trimellitic acid or a nitrilotriacetic acid radical.

A tetravalent radical $R^2$ of a tetracarboxylic acid is for example the tetravalent radical of butane-1,2,3,4-tetracarboxylic acid or of pyromellitic acid.

A divalent radical $R^2$ of dicarbamic acid is for example a hexamethylenedicarbamic acid or a 2,4-toluylene dicarbamic acid radical.

Examples of tetraalkylpiperidine compounds of this class are the following compounds:

(1) 4-hydroxy-2,2,6,6-tetramethylpiperidine
(2) 1-allyl-4-hydroxy-2,2,6,6-tetramethylpiperidine
(3) 1-benzyl-4-hydroxy-2,2,6,6-tetramethylpiperidine
(4) 1-(4-tert.-butyl-2-butenyl)-4-hydroxy-2,2,6,6-tetramethylpiperidine
(5) 4-stearoyloxy-2,2,6,6-tetramethylpiperidine
(6) 1-ethyl-4-salicyloyloxy-2,2,6,6-tetramethylpiperidine
(7) 4-methacryloyloxy-1,2,2,6,6-pentamethylpiperidine (8) 1,2,2,6,6-pentamethylpiperidin-4-yl β-(3,5-di-tert.-butyl-4-hydroxyphenyl)-propionate
(9) Di-(1-benzyl-2,2,6,6-tetramethylpiperidin-4-yl)maleate
(10) Di-(2,2,6,6-tetramethylpiperidin-4-yl)adipate
(11) Di-(2,2,6,6-tetramethylpiperidin-4-yl)sebacate
(12) Di-(1,2,3,6-tetramethyl-2,6-diethyl-piperidin-4-yl)sebacate
(13) Di-(1-allyl-2,2,6,6-tetramethylpiperidin-4-yl)phthalate
(14) 1-propargyl-4-β-cyanoethyloxy-2,2,6,6-tetramethylpiperidine
(15) 1-acetyl-2,2,6,6-tetramethylpiperidin-4-yl acetate
(16) Tri-(2,2,6,6-tetramethylpiperidin-4-yl)trimellitate
(17) 1-acryloyl-4-benzyloxy-2,2,6,6-tetramethylpiperidine
(18) Di-(1,2,2,6,6-pentamethylpiperidin-4-yl)dibutylmalonate
(19) Di-(1,2,2,6,6-pentamethylpiperidin-4-yl)butyl-(3,5-di-tert.-butyl-4-hydroxybenzyl)malonate
(20) Di-(1,2,2,6,6-pentamethylpiperidin-4-yl)dibenzylmalonate
(21) Di-(1,2,3,6-tetramethyl-2,6-diethylpiperidin-4-yl)dibenzylmalonate
(22) Hexane-1',6'-bis-(4-carbamoyloxy-1-n-butyl-2,2,6,6-tetramethylpiperidine)
(23) Toluene-2',4'-bis-(4-carbamoyloxy-1-n-propyl-2,2,6,6-tetramethylpiperidine)
(24) Dimethyl-bis-(2,2,6,6-tetramethylpiperidin-4-oxy)-silane
(25) Phenyl-tris-(2,2,6,6-tetramethylpiperidin-4-oxy)-silane
(26) Tris-(1-propyl-2,2,6,6-tetramethylpiperidin-4-yl)phosphite
(27) Tris-(1-propyl-2,2,6,6-tetramethylpiperidin-4-yl)phosphate
(28) Phenyl-[bis-(1,2,2,6,6-pentamethylpiperidin-4-yl)]phosphonate
(29) Di-(1,2,2,6,6-pentamethylpiperidin-4-yl)sebacate
(30) 4-Hydroxy-1,2,2,6,6-pentamethylpiperidine
(31) 4-Hydroxy-N-hydroxyethyl-2,2,6,6-tetramethylpiperidine
(32) 4-Hydroxy-N-(2-hydroxypropyl)-2,2,6,6-tetramethylpiperidine
(33) 1-Glycidyl-4-hydroxy-2,2,6,6-tetramethylpiperidine (bb) Compounds of the formula (17)

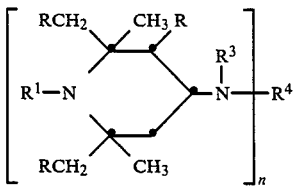

(17)

in which n is the number 1 or 2, R and $R^1$ are as defined under a (a), $R^3$ is hydrogen, $C_1$–$C_{12}$-alkyl, $C_2$–$C_5$-hydroxyalkyl $C_5$–$C_7$-cycloalkyl, $C_7$–$C_8$-aralkyl, $C_2$–$C_{18}$-alkanoyl, $C_3$–$C_5$-alkenoyl or benzoyl, and $R^4$, when n is 1, is hydrogen, $C_1$–$C_{18}$-alkyl, $C_3$–$C_8$-alkenyl, $C_5$–$C_7$-cycloalkyl, hydroxy-, cyano-, alkoxycarbonyl- or carbamido-substituted $C_1$–$C_4$-alkyl, glycidyl, a group of the formula —$CH_2$—CH(OH)—Z or of the formula —CONH—Z, in which Z is hydrogen, methyl or phenyl, or, when n is 2, is $C_2$–$C_{12}$-alkylene, $C_6$–$C_{12}$-arylene, xylylene, a —$CH_2$—CH(OH)—$CH_2$— group or a —$CH_2$—CH(OH)—$CH_2$—O—D—O— group, in which D is $C_2$–$C_{10}$-alkylene, $C_6$–$C_{15}$-arylene or $C_6$–$C_{12}$-cycloalkylene, or, provided that $R^3$ is not alkanoyl, alkenoyl or benzoyl, $R^4$ can also be a divalent radical of an aliphatic, cycloaliphatic or aromatic dicarboxylic acid or dicarbamic acid or, alternatively, the group —CO—, or $R^3$ and $R^4$ together, when n is 1, are the divalent radical of an aliphatic, cycloaliphatic or aromatic 1,2- or 1,3-dicarboxylic acid.

Any $C_1$–$C_{12}$- or $C_1$–$C_{18}$-alkyl substituents are as previously defined under (aa).

Any $C_5$–$C_7$-cycloalkyl substituents are in particular cyclohexyl.

A $C_7$–$C_8$-aralkyl $R^3$ is in particular phenylethyl and especially benzyl. A $C_2$–$C_5$-hydroxyalkyl $R^3$ is in particular 2-hydroxyethyl or 2-hydroxypropyl.

A $C_2$–$C_{18}$-alkanoyl $R^3$ is for example propionyl, butyryl, octanoyl, dodecanoyl, hexadecanoyl, octadecanoyl, but preferably acetyl, and a $C_3$–$C_5$-alkenoyl $R^3$ is in particular acryloyl.

A $C_2$–$C_8$-alkenyl $R^4$ is for example allyl, methallyl, 2-butenyl, 2-pentenyl, 2-hexenyl or 2-octenyl.

A hydroxy-, cyano-, alkoxycarbonyl or carbamido-substituted $C_1$–$C_4$-alkyl $R^4$ can be for example 2-hydroxyethyl, 2-hydroxypropyl, 2-cyanoethyl, methoxycarbonylmethyl, 2-ethoxycarbonylethyl, 2-aminocarbonylpropyl or 2-(dimethylaminocarbonyl)-ethyl.

Any $C_2$–$C_{12}$-alkylene substituents are for example ethylene, propylene, 2,2-dimethylpropylene, tetramethylene, hexamethylene, octamethylene, decamethylene or dodecamethylene.

Any $C_6$–$C_{15}$-arylene substituents are for example o-, m- or p-phenylene, 1,4-naphthylene or 4,4'-diphenylene.

A $C_6$–$C_{12}$-cycloalkylene D is in particular cyclohexylene.

Examples of tetraalkylpiperidine compounds of this class are the following compounds:

(34) N,N'-Bis-(2,2,6,6-tetramethylpiperidin-4-yl)-hexamethylene-1,6-diamine
(35) N,N'-Bis-(2,2,6,6-tetramethylpiperidin-4-yl)-hexamethylene-1,6-diacetamide
(36) 1-Acetyl-4-(N-cyclohexylacetamido)-2,2,6,6-tetramethylpiperidine
(37) 4-Benzoylamino-2,2,6,6-tetramethylpiperidine
(38) N,N'-Bis-(2,2,6,6-tetramethylpiperidin-4-yl)-N,N'-dibutyladipamide
(39) N,N'-Bis-(2,2,6,6-tetramethylpiperidin-4-yl)-N,N'-dicyclohexyl-2-hydroxypropylene-1,3-diamine
(40) N,N'-Bis-(2,2,6,6-tetramethylpiperidin-4-yl)-p-xylylenediamine
(41) The compound of the formula

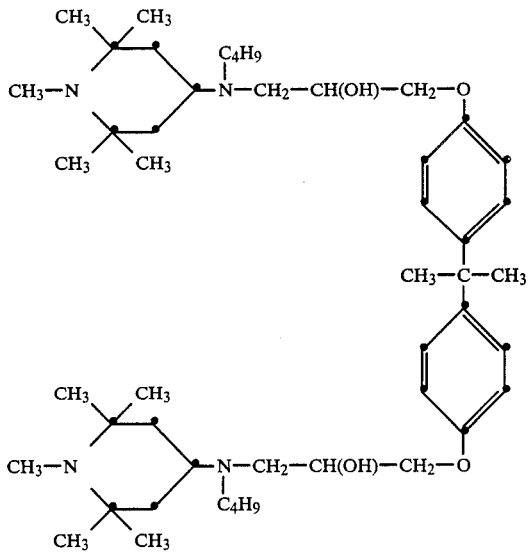

(42) 4-(Bis-2-hydroxyethylamino)-1,2,2,6,6-pentamethylpiperidine

(43) 4-(3-methyl-4-hydroxy-5-tert.-butylbenzamido)-2,2,6,6-tetramethylpiperidine and

(44) 4-Methacrylamido-1,2,2,6,6-pentamethylpiperidine;

(d) 2-(2'-Hydroxyphenyl)-s-triazines of the formula (18)

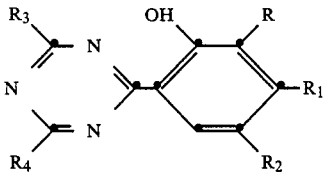

(18)

in which R is hydrogen, halogen, $C_1$–$C_4$-alkyl or sulfo, $R_1$ is hydrogen, $C_1$–$C_4$-alkyl, $C_1$–$C_4$-alkoxy or hydroxy, $R_2$ is hydrogen or sulfo, and $R_3$ and $R_4$ are independently of each other $C_1$–$C_4$-alkyl, $C_1$–$C_4$-alkoxy, $C_5$–$C_6$-cycloalkyl, phenyl or $C_1$–$C_4$-alkyl- and hydroxy-substituted phenyl, it being possible for the sulfo groups to be present in the free form or in the salt form, for example as alkali metal, alkaline earth metal, ammonium or amine salts. Examples of compounds of the formula (18) are 2-(2',4'-dihydroxy-phenyl)-4,6-diphenyl-s-triazine, 2-(2'-hydroxy-4'-methoxy-phenyl)-4,6-diphenyl-s-triazine, 2-(2'-hydroxy-5'-methylphenyl)-4,6-diphenyl-s-triazine, 2,4-bis-(2'-hydroxy-3'-methylphenyl)-6-ethyl-s-triazine, 2,4-bis-(2'-hydroxyphenyl)-6-methoxy-s-triazine, 2,4-bis-cyclohexyl-6-(2'-hydroxy-4'-methoxy-phenyl)-s-triazine or 2-(2'-hydroxy-4'-methoxy-5'-sulfo-phenyl)-4,6-diphenyl-s-triazine; (cf. for example WO-A-86/03,528.

Component (C) can be selected from those compounds which are described for example in Kirk-Othmer (3rd), 3, pages 132–135 or in R. Gächter and H. Müller, Taschenbuch der Kunststoff-Additive [Handbook of plastics additives], Carl Hanser Verlag, Munich, pages 4–78 (1983).

Component (C) can be selected for example from the following compounds:

(a) sterically hindered phenols, for example hydroxyphenyl propionates of the formula (19)

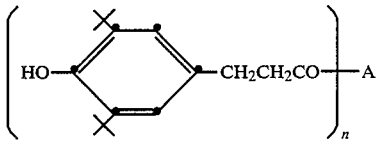

(19)

in which n is an integer from 1 to 4 and A is $C_1$–$C_{24}$-alkoxy, a $-O(CH_2)_6O-$, $-O(CH_2)_2O(CH_2)_2O-$, $-O(CH_2)_2O(CH_2)_2-O(CH_2)_O-$, $-HN-(CH_2)_{2-6}-NH-$ or $-O(CH_2)_2-S-(CH_2)_2O-$ bridge member or a $-(CH_2O)_4-C$ radical, for example the esters of 3-(3',5'-di-tert.-butyl-4-hydroxyphenyl)-propionic acid with methanol, octadecanol, 1,6-hexanediol, diethylene glycol, triethylene glycol or pentaerythritol or the diamides of 3-(3',5'-di-tert.-butyl-4-hydroxyphenyl)propionic acid with ethylenediamine, trimethylenediamine or hexamethylenediamine;

(b) thioethers of the formula (20)

$$ROOC-(CH_2)_2-S-(CH_2)_2-COOR$$

in which R is a $C_8$–$C_{24}$-alkyl radical, for example the dilaurylthiodipropionic acid or distearylthiodipropionic acid derivative;

(c) phosphites of the formula (21)

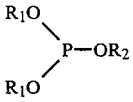

(21)

in which $R_1$ is phenyl, 2,4-di-tert.-butylphenyl or p-nonylphenyl and $R_2$ is n-decyl, 2,4-di-tert.-butylphenyl or p-nonylphenyl, for example tris-(p-nonylphenyl) phosphite, tris-(2,4-di-tert.-butylphenyl) phosphite or diphenyl n-decyl phosphite;

(d) a mixture of a hydroxyphenyl propionate of the above-indicated formula (19) with a phosphite of the above-indicated formula (21) in a molar ratio of (19):(21) ranging from 1:1 to 1:4; or (e) phosphonates of the formula

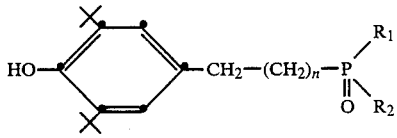

(22)

in which $R_1$ and $R_2$ are independently of each other $C_1$–$C_{24}$-alkoxy and n is 0, 1, 2 or 3.

Examples of compounds of the formula are di-n-octadecyl 1-(3',5'-di-tert.-butyl-4'-hydroxyphenyl)ethanephosphonate, di-ethyl 3,5-di-tert.-butyl-4-hydroxybenzylphosphonate, di-n-butyl 3,5-di-tert.-butyl-4-hydroxybenzylphosphonate and di-n-dodecyl 3,5-di-tert.-butyl-4-hydroxybenzyl-phosphonate.

The above-indicated compounds usable as components (A), (B) and (C) are known and can be prepared by methods known per se.

The compounds of the formulae (7) to (12) are known for example from EP-A-51,188, -113,856 and -162,811 and can be prepared by known methods.

The compounds of the formulae (13) and (14) can be prepared by methods known per se, for example as described in US-A-3,403,183 and US-A-4,127,586 respectively.

The preparation of the compounds from the class of the sterically hindered amines of the formulae (15) to (17) is described for example in US-A-3,640,928, -3,840,494 and -3,993,655.

The compounds of the formula (18) can be prepared in a manner known per se, for example, by the methods described in Helv. 55, 1566–1595 (1972).

The preparation of compounds of the formula (19) can be effected in a manner known per se, for example as described in GB-A-1,103,144.

Compounds of the formula (20) can be prepared in a manner known per se, for example by the method described in US-A-2,468,725.

The phosphites of the formula (21) can likewise be prepared by methods known per se, for example by the method published in US-A-4,187,212.

The phosphonates of formula (22) can be prepared in a manner known per se, for example by the method disclosed in US-A-3,270,091.

The agents according to the invention are advantageously applied from an aqueous bath and are advantageously employed therein in such an amount that for every 1 g of polyamide there is available 5 to 800 μg, in particular 10 to 200 μg, of copper metal. The agents therefore contain (a) 0.005 to 0.8% by weight of an organic copper complex having a 10% copper content, (b) 0.05 to 3, preferably 0.1 to 1, % by weight of a light stabilizer and, if desired, (c) 0.05 to 3, preferably 0.1 to 1, % by weight of an antioxidant.

The agents according to the invention, which likewise form part of the subject-matter of the present invention, are used for stabilizing dyed material before, during or after dyeing. Advantageously, the agent is added directly to the dyebath. Dyeing is carried out continuously or batchwise.

The agents according to the invention are advantageously—unless water-soluble—used in the form of finely divided dispersions (particle size <5 μm) which are obtained by grinding in the presence of customary dispersants.

Polyamide material is to be understood as meaning synthetic polyamide, for example nylon-6, nylon-6,6 or even nylon-12. In addition to pure polyamide fibres, it is also possible to consider in particular fibre mixtures of polyurethane and polyamide, for example tricot material made of polyamide/polyurethane in a mixing ratio of 70:30. In principle, the pure or mixed polyamide material can be present in very widely differing processing forms, for example as fibre, yarn, woven fabric or knitted fabric.

In particular polyamide material which is exposed to light and heat and is present for example, as an automotive upholstery material or in carpet form, is particularly highly suitable for treatment by the present process.

The examples which follow serve to illustrate the invention. Parts and percentages are by weight. The percentages cercerning the additions to the individual treatment baths or dyebaths are based on weight of fibre, unless otherwise stated.

EXAMPLE 1

Four 10 g hanks of nylon-66 staple yarn and four 10 g nylon-66 automotive upholstery tricot pieces are treated in a dyeing apparatus (for example an AHIBA ® instrument) with liquors (liquor ratio 20:1) which generally contain 1 g of ammonium sulfate per liter (pH 6.5) and the following dyes and additives (on weight of fibre): dye of the formula (100)

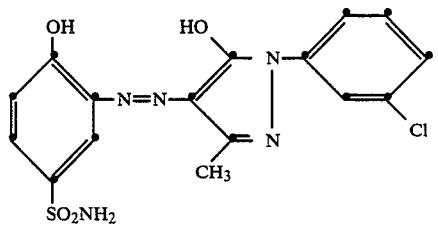

1:2 Co complex (yellow)

dye of the formula (101)

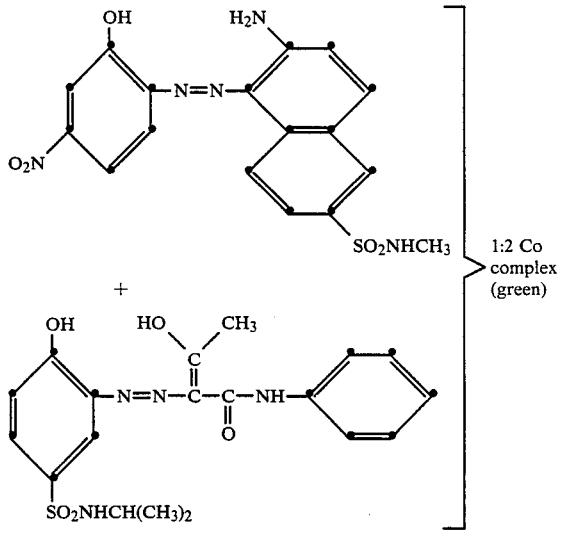

dye of the formula (102)

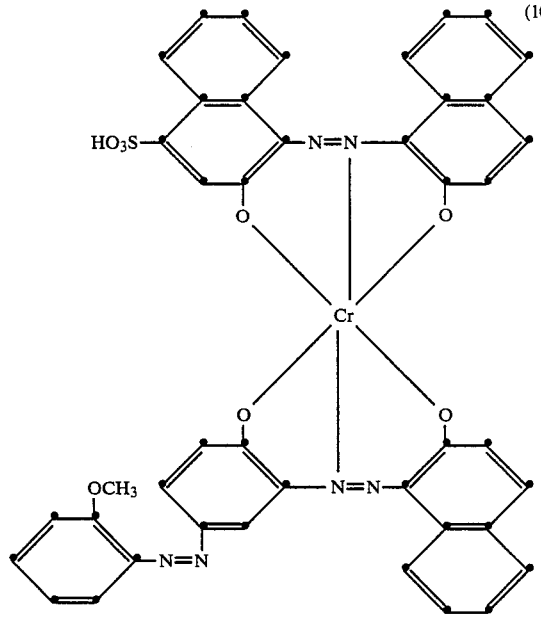

1:2 Cr complex (black)

dye of the formula

-continued

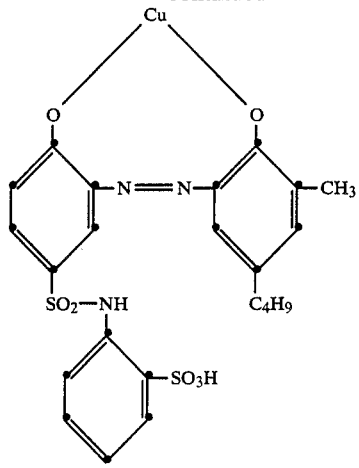

1:1 Cu complex (yellow)

dye of the formula (103)

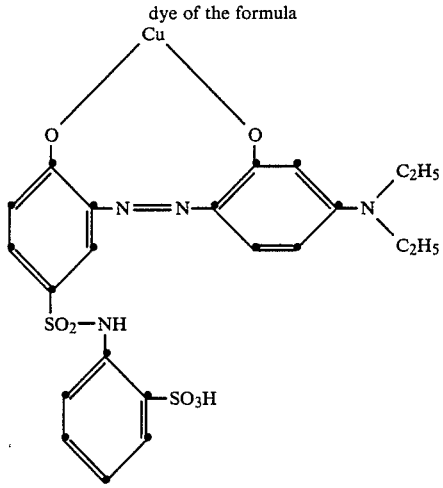

1:1 Cu complex (red)

light stabilizer of the formula (105)

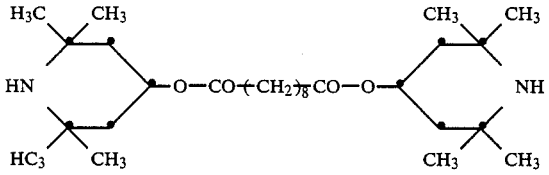

in a finely dispersed form (particle size <4 μm), ground with the condensation product of naphthalenesulfonic acid and formaldehyde, as a dispersant, in a weight ratio of 1:1.

| | |
|---|---|
| Dyeing liquor 1: | 0.05% of the dye of the formula (100)<br>0.08% of the dye of the formula (101)<br>0.035% of the dye of the formula (102)<br>(olive dyeing) |
| Dyeing liquor 2: | 0.08% of the dye of the formula (101)<br>0.035% of the dye of the formula (102)<br>0.055% of the dye of the formula (103)<br>0.008% of the dye of the formula (104)<br>(olive dyeing) |
| Dyeing | like dyeing liquor 2 plus 1% of the light |

-continued

| | |
|---|---|
| liquor 3: | stabilizer of the formula (106) |

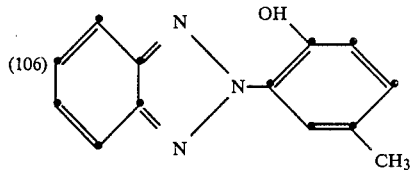

| | |
|---|---|
| Dyeing liquor 4: | like dyeing liquor 2, except for aftertreatment of the dyeing with 0.65% of the light stabilizer of the formula (105) and 1.00% of 80% acetic acid, diluted with water, at 60° C. for 45 minutes. |

The completed dyeings are rinsed and dried and tested as follows:

(a) Light fastness properties

The tricot material is tested:

xenon light in accordance with Swiss Standard SN-ISO 105,B02

FAKRA (DIN Automotive Industry Standards Committee) light in accordance with DIN 75,202 (hot exposure)

(b) Photostability

The polyamide stable yarn is wound onto cardboard and exposed under FAKRA light conditions for 150 hours. Thereafter the yarn is tested in accordance with Swiss Standards Association standard SNV 197.461 in respect of its breaking strength and elongation. The results obtained are given below, the breaking strength and the elongation of unexposed and untreated nylon-66 staple yarn being set equal to 100%.

TABLE 1

| Dyeing Liquor | Light fastness Xenon | Light fastness FAKRA | Breaking strength/elongation in % Exposure under FAKRA Light for 150 h |
|---|---|---|---|
| 1 | 7 | 6 | 9.0/14.7 |
| 2 | 6 | 6 | 30.5/45.6 |
| 3 | 6–7 | 6–7 | 40.1/47.0 |
| 4 | 6–7 | –7 | 44.6/57.6 |
| Blank dyeing | — | — | 9.9/15.5 |

These results show that (a) the dyeing from dyeing liquor 1 has, as the values of breaking strength and elongation illustrate, an extremely low photochemical stability in a 150-hour hot exposure test in accordance with FAKRA, (b) the presence of Cu complex dyes of the formulae (103) and (104) causes a distinct increase in the photochemical stability, (c) the photochemical stability is improved by the presence of the light stabilizer of the formula (106) or (105), and (d) the light fastness properties, in particular those in accordance with FAKRA, are improved by the compound of the formula (106) or (105).

EXAMPLE 2

The dyeing of the nylon-66 yarns and of the tricot material is effected as described in Example 1, except for the following differences Dyeing liquor 5: 0.05% of the dye of the formula -continued (200)

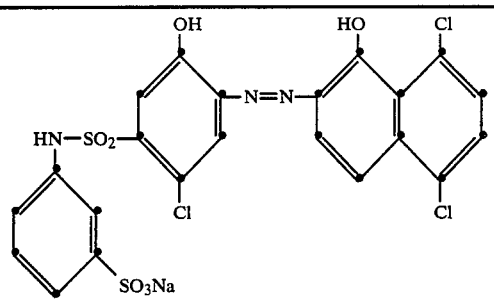

1:1 Cu complex

Dyeing liquor 6: 0.05% of the dye of the formula (200)
1.0% of the light stabilizer of the formula (201)

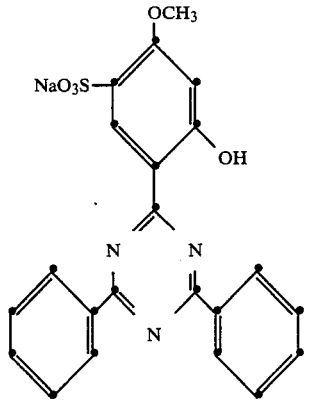

Dyeing liquor 7: 0.05% of the dye of the formula (200)
1.0% of the light stabilizer of the formula (202)

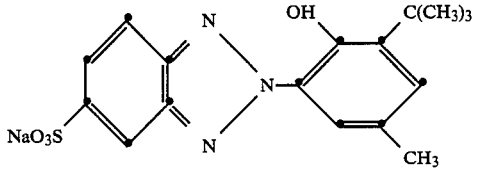

Dyeing liquor 8: 0.05% of the dye of the formula (200)
0.4% of the compound of the formula (203)

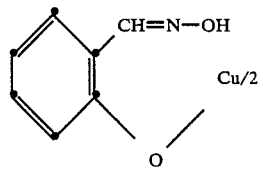

(as a 10% sand-milled product).

Dyeing liquor 9: 0.05% of the dye of the formula (200)
0.4% of the compound of the formula (203)
1.0% of the light stabilizer of the formula (202)

Dyeing liquor 10: 0.25% of the dye of the formula (200)

Dyeing liquor 11: 0.25% of the dye of the formula (200)
1.0% of the light stabilizer of the formula (201)

Dyeing liquor 12: 0.25% of the dye of the formula (200)
1.0% of the light stabilizer of the formula (202)

The completed dyeings are rinsed and dried and tested as described in Example 1.

The results are summarized in the following table:

| | | | |
|---|---|---|---|
| 5 | 4 | << 4 | 48.8/51.2 |
| 6 | 4–5 | 4 | 52.8/55.8 |
| 7 | 5 | 4 | 52.8/53.4 |
| 8 | 5 | 4 | 60.1/62.4 |
| 9 | 5–6 | 4–5 | 66.7/65.9 |
| 10 | 5–6 | 4–5 | 60.9/62.8 |
| 11 | 6 | 5–6 | 67.9/61.1 |
| 12 | 6 | 5–6 | 66.6/65.2 |
| Blank dyeing | — | — | 12.5/13.4 |

The results imply that the light stabilizers improve the light fastness of the dyeings. By increasing the amount of copper in the fibre it is additionally possible to slow down photochemical degradation (dyeing liquors 8 and 9).

EXAMPLE 3

The dyeings are carried out on nylon-66 tricot with 0.1% and 0.25% of the dye of the formula (200) as described in Example 2. The dyeings are then halved. While halves 1 and 3 remain unchanged, halves 2 and 4 are after-treated at 65° C. for 30 minutes in a liquor ratio of 25:1 with a liquor which contains 1.5% of the compound of the formula

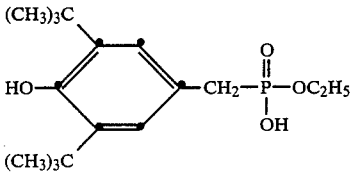

(300)

and 1.0% of 80% acetic acid.

All the 4 dyeings are tested after rinsing and drying in respect of their light fastness properties.

The results are given in Table 3 below.

TABLE 3

| Dyeing No. | Dye (200) | Light stabilizer (300) | Light fastness Xenon | FAKRA |
|---|---|---|---|---|
| 1 | 0.1% | — | 4 | < 4 |
| 2 | 0.1% | 1.5% | 5 | 4 |
| 3 | 0.25% | — | 5–6 | 4–5 |
| 4 | 0.25% | 1.5% | 6–7 | 5–6 |

EXAMPLE 4

The dyeings are carried out as described in Example 1, except for the following differences:

Dyeing Liquor 13: 0.025% of the dye of the formula (101)
0.050% of the dye of the formula (103) (light green hue)

Dyeing Liquor 14: 0.025% of the dye of the formula (101)
0.050% of the dye of the formula (103) (light green hue)
1.0% of the light stabilizer of the formula (400)

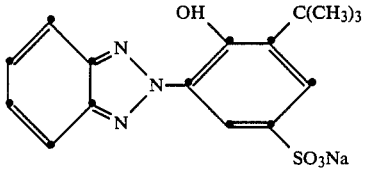

Dyeing Liquor 15: 0.025% of the dye of the formula (101)
0.050% of the dye of the formula (103) (light green hue)

-continued 1.0% of the light stabilizer of the formula (400)
0.075% of the compound of the formula (401)

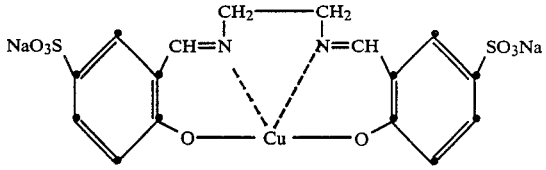

Dyeing Liquor 16: 0.025% of the dye of the formula (101)
0.050% of the dye of the formula (103) (light green hue)
1.0% of the light stabilizer of the formula (400)
0.05% of the compound of the formula (402)

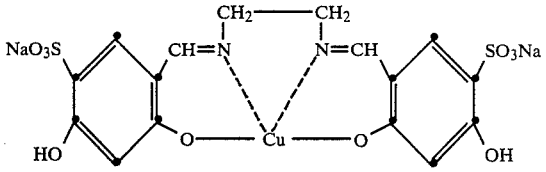

(as 10% sand milling)

Dyeing Liquor 17: 0.025% of the dye of the formula (101)
0.050% of the dye of the formula (103) (light green hue)
1.0% of the light stabilizer of the formula (400)
0.5% of the compound of the formula (403)

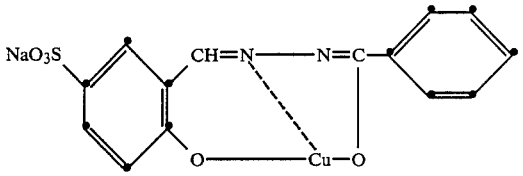

(as 10% sand milling)

The completed dyeings are rinsed and dried and tested as in Example 1.

The results are given in the table below.

TABLE 4

| Dyeing Liquor | Light fastness Xenon | FAKRA | Breaking strength/elongation in % Exposure under FAKRA Light for 150 h |
|---|---|---|---|
| 13 | 5 | 4–5 | 44.9/53.1 |
| 14 | 6–7 | 5–6 | 58.0/62.0 |
| 15 | 6–7 | 6 | 68.5/67.2 |
| 16 | 6–7 | 6 | 69.2/67.1 |
| 17 | 6–7 | 6 | 63.1/62.2 |
| Blank dyeing | — | — | 12.5/13.4 |

The results show that the light stabilizers improve the light fastness of the dyeings and that increasing the amount of copper in the fibre slows down photochemical degradation (dyeing liquors 15–17).

What I claim is:

1. A process for the photochemical stabilization of polyamide fibre material or mixtures thereof with other fibre materials, which comprises applying to the fibre material from an aqueous bath a mixture of (A) a water-soluble copper complex azo dye or a mixture of a water-soluble copper complex azo dye and a non-chromophoric water-soluble copper complex which has fibre affinity and is selected from the group consisting of bisazomethines, acylhydrazones, semicarbazones and thiosemicarbazones of aromatic aldehydes and ketones, (B) a light stabilizer selected from the group consisting of 2-hydroxybenzophenone, 2-(2'-hydroxyphenyl)-benzotriazole and sterically hindered amines, and if desired (C) an antioxidant.

2. a process according to claim 1, wherein water soluble copper complexes of azo dyes of the formula

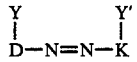

in which D is a radical of the benzene or naphthalene series, Y is an HO, $CH_3O$ or HOOC group and Y' is an HO or an amino group, and in which K is the radical of a coupling component of the benzene, naphthalene or heterocyclic series or the radical of a ketomethylene compound are used.

3. A process according to claim 2, wherein the copper complex dye used has the formula

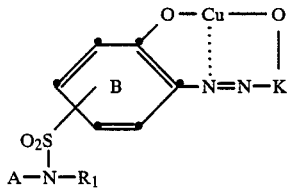

(2)

in which A is a substituted or unsubstituted carboxyphenyl or sulfophenyl radical, $R_1$ is hydrogen or $C_1$–$C_4$-alkyl, K is the radical of a coupling component of the benzene, naphthalene, pyrazolone, aminopyrazole, acetoacetanilide, 2,4-dioxyquinoline, pyridone or pyridine series, and the ring B can be further substituted, for example by chlorine or nitro.

4. A process according to claim 1, wherein the nonchromophoric watersoluble copper complex with affinity for fibre has the formula

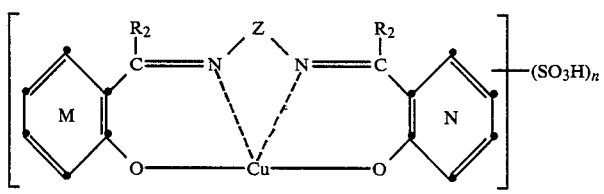

(5)

in which $R_2$ is hydrogen or a substituted or unsubstituted alkyl or aryl radical, Z is a substituted or unsubstituted alkylene or cycloalkylene radical, n is 1, 2 or 3, and the rings M and N can be substituted independently of each other.

5. A process according to claim 1, wherein the nonchromophoric watersoluble copper complex with fibre affinity has the formula

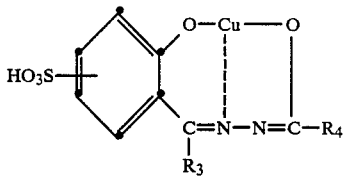

in which $R_3$ and $R_4$ are independently of each other defined in the same way as $R_2$ in claim 4.

6. A process according to claim 1, wherein the nonchromophoric watersoluble copper complex with fibre affinity has the formula

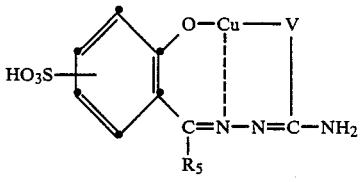

in which $R_5$ is hydrogen or a substituted or unsubstituted alkyl or aryl radical and V is an oxygen or sulfur atom.

7. A process according to claim 1, wherein, in the mixture used, the ratio of copper complex dye: nonchromophoric water-soluble copper complex compound with fibre affinity but having no dye characteristics itself is 99:1 to 10:90.

8. A process according to claim 1, wherein copper complex azo dyes or mixtures of water-soluble copper complex compounds are used in such an amount that for every 1 g of polyamide material there is available 2 to 4000 μg of copper.

9. A process according to claim 1, wherein component (A) azo is used together with acid dyes.

10. A process according to claim 9, wherein component (A) azo is used together with acid dyes or weakly acid dyeable dyes in the same dyebath.

11. A process according to claim 10, wherein the acid dyes used are metal-free monoazo or polyazo dyes, 1:2 chromium or 1:2 cobalt complex azo dyes, anthraquinone, dioxazine, phthalocyanine, nitroaryl or stilbene dyes which have at least one carboxy, sulfo, $C_1$–$C_4$-alkylsulfonyl, sulfamoyl or $C_1$–$C_4$-dialkylsulfamoyl group.

12. A process according to claim 9, wherein, for trichromatic dyeing, a mixture of at least one red-dyeing dye, at least one yellow- or orange-dyeing dye and at least one blue-dyeing dye is used, the mixture containing at least one copper complex dye.

13. A process according to claim 1, wherein component (B) is a 2-hydroxybenzophenone of the formula

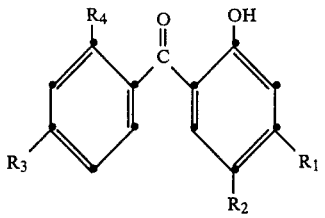

in which $R_1$ is hydrogen, hydroxy, $C_1$–$C_{14}$-alkoxy or phenoxy, $R_2$ is hydrogen, halogen, $C_1$–$C_4$-alkyl or sulfo, $R_3$ is hydrogen, hydroxy or $C_1$–$C_4$-alkoxy and $R_4$ is hydrogen, hydroxy or carboxy.

14. A process according to claim 1, wherein component (B) is a 2-(2'-hydroxyphenyl)-benzotriazole of the formula

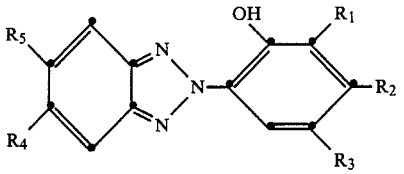

in which $R_1$ is hydrogen, $C_1$–$C_{12}$-alkyl, chlorine, $C_5$–$C_6$-cycloalkyl, $C_7$–$C_9$-phenylalkyl or sulfo, $R_2$ is hydrogen, $C_1$–$C_4$-alkyl, $C_1$–$C_4$-alkoxy, chlorine, hydroxy or sulfo, $R_3$ is $C_1$–$C_{12}$-alkyl, $C_1$–$C_4$-alkoxy, phenyl, ($C_1$–$C_8$-alkyl)-phenyl, $C_5$–$C_6$-cycloalkyl, $C_2$–$C_9$-alkoxycarbonyl, chlorine, carboxyethyl, $C_7$–$C_9$-phenylalkyl or sulfo, $R_4$ is hydrogen, chlorine, $C_1$–$C_4$-alkyl, $C_1$–$C_4$-alkoxy, $C_2$–$C_9$-alkoxycarbonyl, carboxy or sulfo and $R_5$ is hydrogen or chlorine.

15. A process according to claim 1, wherein component (B) is a compound from the class of the sterically hindered amines.

16. A process according to claim 15, wherein the sterically hindered amine used is a 2,2,6,6-tetraalkylpiperidine derivative which contains in its molecule at least one group of the formula

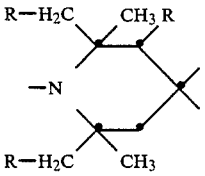

in which R is hydrogen or methyl.

17. A process according to claim 1, wherein component (B) is a 2-(2'-hydroxyphenyl)-s-triazine of the formula

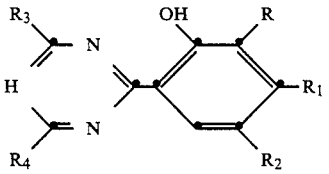

in which R is hydrogen, halogen, $C_1$–$C_4$-alkyl or sulfo, $R_1$ is hydrogen, $C_1$–$C_4$-alkyl, $C_1$–$C_4$-alkoxy or hydroxy, $R_2$ is hydrogen or sulfo, and $R_3$ and $R_4$ are independently of each other $C_1$–$C_4$-alkyl, $C_1$–$C_4$-alkoxy, $C_5$–$C_6$-cycloalkyl, phenyl or $C_1$–$C_4$-alkyl- and hydroxy-substituted phenyl.

18. A process according to claim 1, wherein component (C) is a hydroxyphenyl propionate of the formula

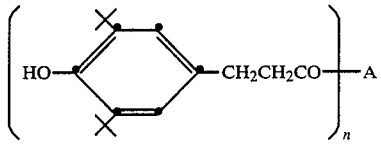

in which n is an integer from 1 to 4 and A is $C_1$–$C_{24}$-alkoxy, a $—O(CH_2)_6O—$, $—O(CH_2)_2O(CH_2)_2O—$, $—O(CH_2)_2O(CH_2)_2—O(CH_2)_2O—$, $—HN—(CH_2)_{2-6}—NH—$ or $—O(CH_2)_2—S—(CH_2)_2O—$ bridge member or a $—(CH_2O)_4$-C radical.

19. A process according to claim 1, wherein component (C) is a thioether of the formula $$ROOC—CH_2CH_2—S—CH_2CH_2COOR$$

in which R is a $C_8$–$C_{24}$-alkyl radical.

20. A process according to claim 1, wherein component (C) is a phosphite of the formula

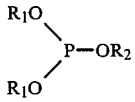

in which $R_1$ is phenyl, 2,4-di-tert.-butylphenyl or nonylphenyl and $R_2$ is n-decyl, 2,4-di-tert.-butylphenyl or nonylphenyl.

21. A process according to claim 1, wherein component (C) is a mixture of a hydroxyphenyl propionate of the formula

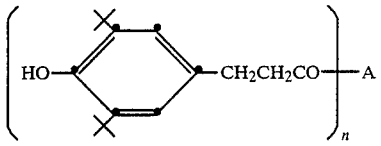

with a phosphite of the formula

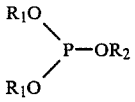

in which n is an integer from 1 to 4 and A is $C_1$–$C_{24}$-alkoxy, a $—O(CH_2)_6O—$, $—NH—(CH_2)_{2-6}—NH—$, $—OCH_2CH_2—NH—OC—CO—NH—CH_2CH_2O—$, $—OCH_2CH_2OCH_2CH_2O—$, $—OCH_2CH_2OCH_2CH_2OCH_2CH_2O—$ or $—O(CH_2)_2—S—(CH_2)_2O—$ bridge member or a $—(CH_2O)_4—C$ radical, $R_1$ is phenyl, 2,4-di-tert.-butylphenyl or nonylphenyl and $R_2$ is n-decyl 2,4-di-tert.-butylphenyl or nonylphenyl, in a molar ratio of hydroxyphenyl propionate:phosphite ranging from 1:1 to 1:4.

22. A process according to claim 1, wherein component (C) is a phosphonate of the formula
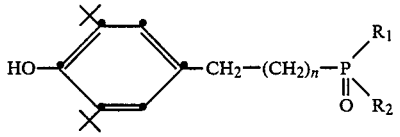
(22)
in which $R_1$ and $R_2$ are independently of each other $C_1$–$C_{24}$-alkoxy and n is 0, 1, 2 or 3.
23. A polyamide fibre material treated in accordance with the process claimed in claim 1, and mixtures thereof with other fibre materials.
* * * * *